US005314196A

United States Patent [19]

Ruelle

[11] Patent Number: 5,314,196

[45] Date of Patent: May 24, 1994

[54] ARROW CONSTRUCTION FOR USE IN BOW HUNTING

[76] Inventor: Robert J. Ruelle, 952 Bloomfield Village "F", Auburn Hills, Mich. 48326

[21] Appl. No.: 937,998

[22] Filed: Aug. 28, 1992

[51] Int. Cl.[5] ..... F42B 6/04; F42B 6/06; F42B 6/08

[52] U.S. Cl. ..... 273/416; 273/421

[58] Field of Search ..... 273/421, 422, 416, 419, 273/420

[56] References Cited

U.S. PATENT DOCUMENTS

| | | | |
|---|---|---|---|
| 1,542,762 | 6/1925 | Cole | 273/416 |
| 2,289,284 | 7/1942 | Changler . | |
| 2,599,626 | 6/1952 | Gottschalk . | |
| 2,671,664 | 3/1954 | Zwickey . | |
| 2,939,708 | 6/1960 | Scheib . | |
| 3,014,305 | 12/1961 | Yurchich . | |
| 3,034,789 | 5/1962 | Moore | 273/416 |
| 3,036,396 | 5/1962 | Swails . | |
| 3,138,383 | 6/1964 | McKinzie . | |
| 3,164,385 | 1/1965 | Shure . | |
| 3,168,313 | 2/1965 | Lint . | |
| 3,340,642 | 9/1967 | Vasiljevic . | |
| 3,600,835 | 8/1971 | Hendricks . | |
| 3,738,657 | 6/1973 | Cox | 273/420 |
| 4,166,619 | 9/1979 | Bergmann et al. | 273/421 |
| 4,452,460 | 6/1984 | Adams | 273/422 |
| 4,579,348 | 4/1986 | Jones | 273/421 |
| 4,900,037 | 2/1990 | Miller | 273/416 |
| 4,901,467 | 2/1990 | Stolpe . | |

OTHER PUBLICATIONS

Bow & Arrow Hunting, Oct. 1986 p. 45 Saunders Archery "Limiters".

Advertisement Brochure for Punchcutter 1990.

*Primary Examiner*—Paul E. Shapiro

*Attorney, Agent, or Firm*—Gifford, Groh, Sprinkle, Patmore and Anderson

[57] ABSTRACT

An arrow construction for use with a bow in hunting wild game provides an arrow shaft having a hollow interior. An arrowhead attaches to a leading end of the arrow shaft. A nock attaches to a trailing end of the arrow shaft. A stop member is provided within the shaft of the arrow and activates to an open position external to the shaft to restrain further travel of the arrowhead when it becomes embedded within the game. The stop member activates to the open position upon the arrow impacting the desired target. A slidably detachable arrowhead is also provided and is forceably detached from the leading end of the arrow upon the arrow's impacting the desired target. The arrowhead translates along the arrow shaft in a direction toward the trailing end. Further translation of the arrowhead is prevented by an abutting engagement with the stop member in its activated position. A spring loaded nock at the trailing end of the arrow shaft is also provided and compensates for frictional losses inherited by the arrow upon disengagement of the arrow from the bowstring when the arrow is fired.

11 Claims, 3 Drawing Sheets

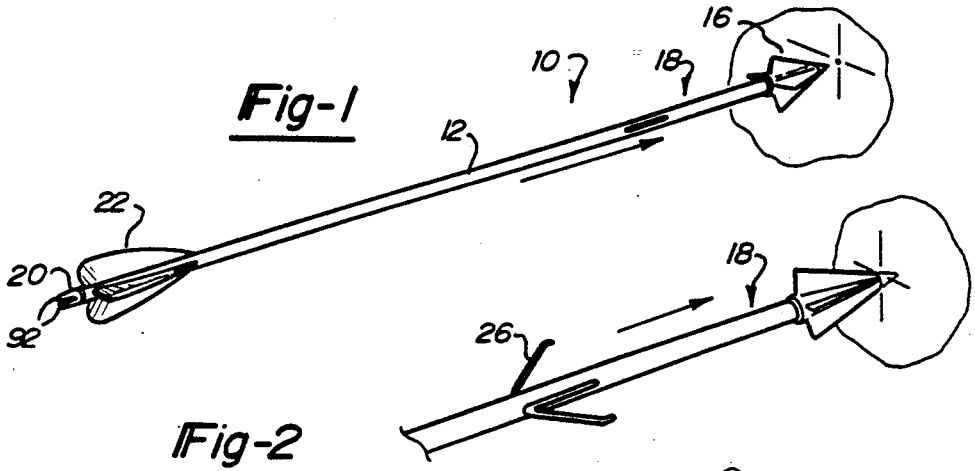
Fig-1
Fig-2
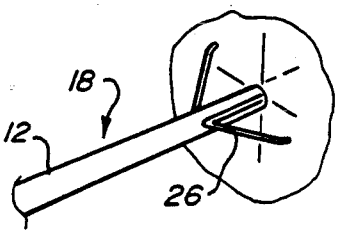
Fig-3
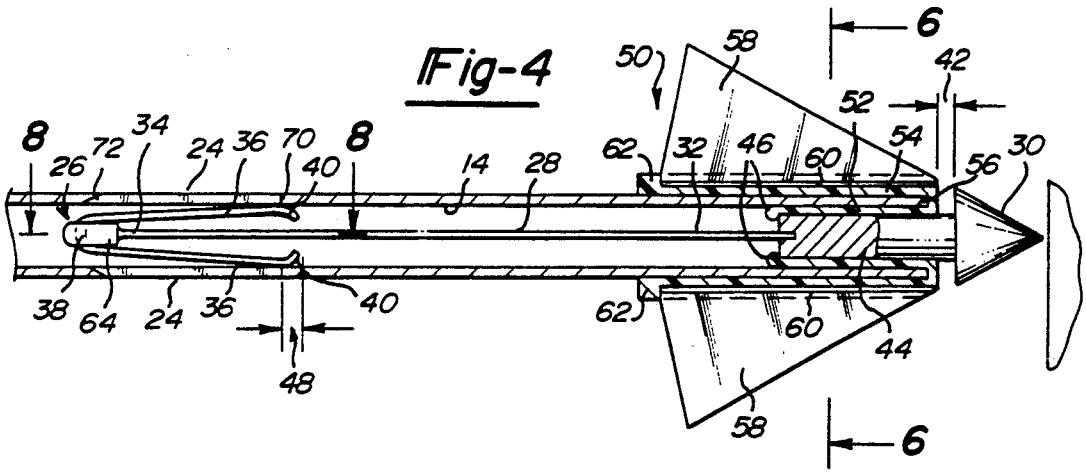
Fig-4
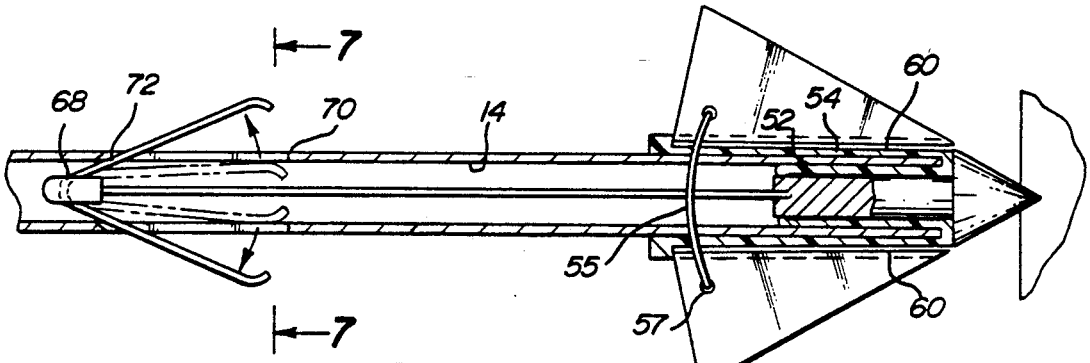
Fig-5

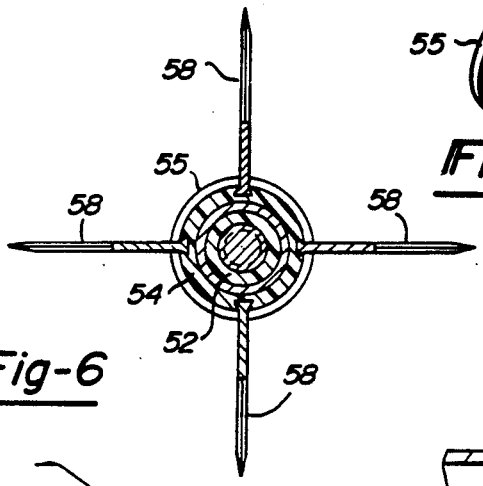
Fig-6
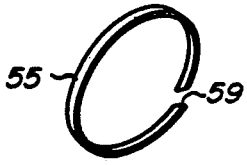
Fig-6A
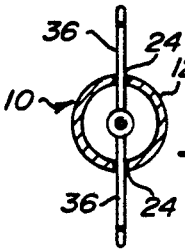
Fig-7
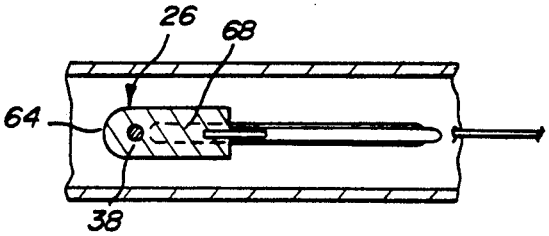
Fig-8
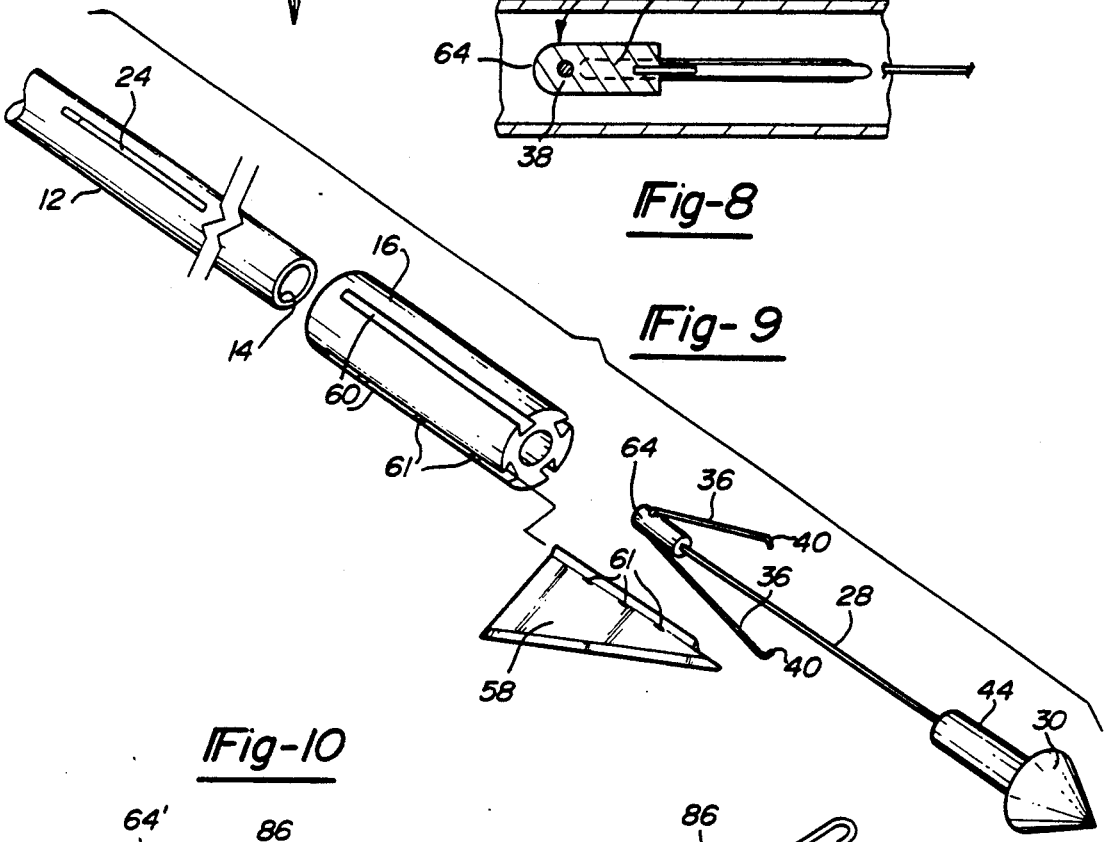
Fig-9
Fig-10
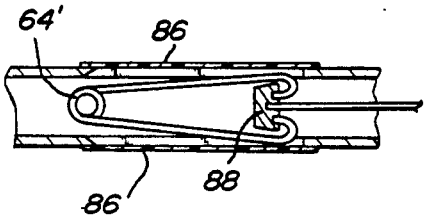
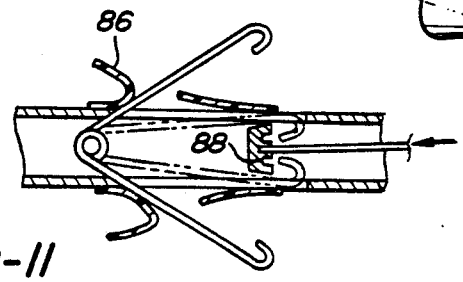
Fig-11

ARROW CONSTRUCTION FOR USE IN BOW HUNTING

BACKGROUND OF THE INVENTION

I. Field of the Invention

The present invention relates to archery and, more particularly, an arrow construction for use in bow hunting.

II. Description of the Prior Art

Various assemblies for enhancing the performance of an arrow used in bow hunting are known in the art. The object of the known arrow assemblies is to enhance both the performance of the arrow and the striking power of the arrow's arrowhead when hunting various wild game. Among the most difficult of these pursuits is the hunt for various species of deer.

Due to the tendency of wild deer to bolt upon being struck by an arrow, an important feature of an arrow's arrowhead is it's ability to perform the maximum amount of damage to the internal organs of the deer in order to bring the deer down within the shortest possible distance. The brochure, "Harvest with Punch Cutter", distributed by Forest Line International Corporation, teaches an arrangement of blades within the arrowhead of the arrow which expand outwardly to increase the cutting effect of the arrowhead as it travels through the animal's hide. The drawback of the punch cutter apparatus is that the blades are admitted to open and close during the flight of the arrow. This causes undesirable aerodynamic variations to be introduced to the arrow during the arrow's trajectory.

Another shortcoming of the known arrow assemblies is their tendency to exit the other side of the animal's hide, due to the high velocities at which they travel. This is disadvantageous from the point of view that the arrowhead of an arrow which remains within the internals of a wild animal during its final run tends to create more internal damage to the animal and thus drop the animal in a shorter distance. The brochure, "Harvest with Punch Cutter", teaches that the Punch Cutter blades will open to a particular rearward position, indicated at "C", which would not likely provide sufficient stopping forces to prevent the arrowhead from exiting the opposite side of the animal's hide.

U.S. Pat. No. 3,036,393, issued to Swails, discloses a retractable arrow assembly for use in hunting fish and the like. Retractable barbs are provided in the shaft of the arrow which open up in a direction facing away from the arrow's tip. This is done so that the arrow will remain embedded in the fish and can be withdrawn from the pond or river with the fish still attached thereto. However, the shortcoming of Swails is that it teaches the barb's opening in a direction away from the tip of the arrow for the express purpose of fishing. Consequently, this would provide no stopping action for the benefit of the arrowhead at the tip of a hunting arrow as it travels through a fish's or animal's hide. Swails also teaches that the barbs will remain recessed within the arrow's shaft as long as the arrow is in motion. The barbs of Swails are only biased to project outwardly when the arrow becomes stationary with respect to the object struck.

The "Viper Broadhead Simulator" discloses a displaceable arrowhead for target practice composed of forward raking teeth. Upon impact of the arrow with the target, the simulated broadhead is forceably displaced from a compressible rubber tip on the arrow-shaft. Displacement is accomplished by the removal of a retention washer provided adjacent the rear of the arrowhead. The purpose of the "Viper Broadhead Simulator" is to provide a simulated broadhead for target practice which more clearly imitates the weight and aerodynamics of actual broadheads. The detachable broadhead provides for easier removal of the practice arrow from the target. The shortcoming of the "Viper" disclosure is that it fails to disclose a detachable arrowhead for use in combination with a stop or catch mechanism located on the arrow shaft for interrupting the travel of the blades at a desired point to optimize the broadhead's effect on the animal.

U.S. Pat. No. 4,900,037, issued to Miller, discloses an accelerating arrow having a compressible coil spring which extends from the arrow's nock. The coil spring extends a considerable longitudinal distance beyond the vanes or feathers of the arrow. The arrow's nock is positioned at the free end of the coil spring. During the draw stage, the coil spring becomes compressed from the forces exerted on the spring. As the arrow is released, the spring absorbs the recoil forces of the bow and directs them along the longitudinal path of release of the arrow. The coil spring stiffness is approximately the actual draw power of the bow.

The shortcoming of the Miller reference is that undesirable directional forces may be applied to the arrow during its trajectory due to the stiffness power of the coil spring, with resulting undesirable effects in the arrow's travel. Further, Miller does not teach utilizing a coil spring for the limited purpose of compensating for frictional losses to the arrow due to disengagement of the bowstring from the arrow nock, rather it seeks to affect the acceleration and velocity of the arrow once it leaves the bow.

SUMMARY OF THE PRESENT INVENTION

The present invention provides a novel arrow construction for use with a bow in hunting wild game. The arrow has a hollow shaft to which an arrowhead is attached at a leading end thereof in proximity to the arrow's tip. A nock is attached to a trailing end of the arrow's shaft. A stop member is provided within the shaft and is activated to extend outwardly in a radial direction to restrain the travel of the arrow through the body of the animal once the arrowhead impacts the animal.

In a first embodiment, the stop member is activated from the closed to the open position by the displacement of a stem disposed within the hollow interior of the arrow's shaft. A first end of the stem is attached to a tip of the arrow and the opposite end is attached to the stop member. The stop member has two resiliently biased fingers which are biased against the hollow interior of the arrow shaft adjacent to the ends of the slots in the closed position. The tip of the arrow is spaced a predetermined distance from the leading end of the arrow shaft and is displaceable towards the shaft upon the arrowhead striking the animal. The displacement of the tip of the arrow displaces the stem and the stop member, releasing the ends of the fingers into the slots. A torsional spring integrally formed with the stop member activates the stop member through the slots in the arrow shaft to its open position.

Alternatively, the stop member may be biased in its closed position by a catch mechanism connected to the second end of the stem. The stop member in this embodiment is fixed in an aligned position with respect to the slots. The catch mechanism is displaced by the stem away from the tips of the stop member, permitting the stop member to activate to its open position.

In a further embodiment, the means for actuating the stop member to its open position is provided by a circular bead insertable into the hollow shaft. A dimple is formed radially about the internal diameter of the hollow shaft and restrains the circular bead from movement. Inertial forces, generated from the arrow striking the animal, cause the circular bead to overcome the retraining forces of the dimple and to be propelled forward within the hollow shaft toward its leading end. The bead impacts a displacing member placed within the shaft. The displacing member has a U-shaped channel formed longitudinally therein which houses the stop member. In similar fashion to the above-mentioned embodiment, the displacing member is translated along the shaft in response to the striking of the bead until the ends of the stop member enters the slotted portions of the shaft permitting its fingers to activate outward to their open position.

In a further embodiment, the broadhead of the arrow is slidably detachable from the leading end of the shaft and can be translated along the shaft to engage the stop member in its open position. This ensures that the broadhead of the arrow does not exit the opposite side of the animal's body, but rather, remains embedded within the animal's internal organs once the stop member catches on the animal's hide.

In a final embodiment, a coil spring having a low stiffness factor is provided and extends longitudinally from the arrow nock. The coil spring provides compensation for the frictional losses inherited by the arrow upon its disengagement from the bowstring of the bow. The embodiment of the spring loaded nock is not concerned with affecting the acceleration and velocity of the arrow, but rather, only with compensating for the frictional losses of the arrow due to its disengagement of the bowstring.

BRIEF DESCRIPTION OF THE DRAWINGS

Reference is made to the attached drawings, wherein like reference numbers refer to like parts throughout the several views, and in which:

FIG. 1 is a perspective view of the arrow construction of the present invention;

FIG. 2 is a sectional view similar to that shown in FIG. 1 and showing the stop member of the present invention;

FIG. 3 is a sectional view similar to that shown in FIG. 2 and showing the stop member engaging the target;

FIG. 4 is a view of a first preferred embodiment of the present invention showing the stop member in its closed position;

FIG. 5 is a view similar to that shown in FIG. 4 and showing the stop member in its actuated position;

FIG. 6 is a frontal cut-away view taken along line 6—6 of FIG. 4 and showing the arrowhead assembly of the present invention;

FIG. 6A is a view of the circular ring of the present invention;

FIG. 7 is a cut-away view taken along line 7—7 of FIG. 5 showing the actuated stop member and the slotted portions of the arrow shaft;

FIG. 8 is a cut-away view taken along line 8—8 of FIG. 4 of the stop member of the present invention;

FIG. 9 is an exploded view of the first preferred embodiment of the present invention;

FIG. 10 is a sectional view of a further preferred embodiment of the stop member of the present invention;

FIG. 11 is a view similar in nature to PIG. 10 and showing the breakable stretch membrane placeable over the arrow shaft slots of the present invention;

DETAILED DESCRIPTION OF A PREFERRED EMBODIMENT OF THE PRESENT INVENTION

Figure 12:
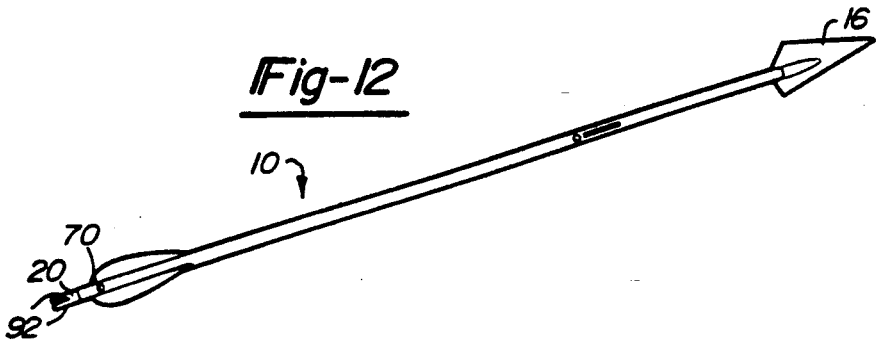
FIG. 12 is a perspective view of a further preferred embodiment of the present invention.

Referring to FIGS. 1 through 4, an arrow 10 for use with a bow in hunting wild game is shown and includes a shaft 12. The shaft 12 is preferably constructed of a durable aluminum or other lightweight material. Referring to FIG. 4, the shaft 12 has an elongated tubular shape having an inner cylindrical wall 14 which defines a hollow interior. An arrowhead 16 attaches to a leading end 18 of the shaft 12. An arrow nock 20, conversely, attaches to the trailing end 22 of the shaft 12. The shaft 12 has slots 24 formed longitudinally there along which extend a predetermined longitudinal distance along the shaft 12. Upon the arrow 10 striking an animal, a stop member 26 springs out through the slots 24 from the inside of the shaft 12 and grabs onto the animal's hide, restraining further travel of the arrowhead 16 into the animal.

Referring again to FIG. 4, in a first preferred embodiment, a stem 28 is longitudinally disposed within the hollow interior of the shaft 12. An arrow tip 30 attaches to a leading end 32 of the stem 28. The stop member 26, conversely, attaches to a trailing end 34 of the stem 28. The stop member 26 preferably includes a pair of resilient fingers 36. The fingers 36 are preferably constructed of a durable metal and are joined at a common base 38 so as to be one piece. The free ends 40 of the fingers 36 are biased to angle outwardly and engage the hide of the animal. Prior to the arrow engaging an animal, the free ends of the fingers 36 are compressed towards each other and are stored in the hollow interior of the shaft 12, as shown in FIG. 4. The inner cylindrical wall 14 of the shaft 12 holds the fingers 36 in their closed position.

The tip 30 of the arrow 10 is spaced a predetermined distance 42 forward of the leading end 18 of the shaft 12 and includes a body portion 44 concentric with and slidably received within the inner cylindrical wall 14. The tip 30 is displaced towards the hollow shaft 12 upon the arrow 10 striking the animal. The stem 28, attached to the tip 30, accordingly is displaced and, in turn, displaces the stop member 26 in a longitudinal direction away from the front end of the arrow until the ends of the fingers 36 enter the slots 24. Upon entering into the slots 24, the stop member 26 expands to its second opened position, as shown in FIG. 2.

Referring again to FIGS. 4 and 5, an internal sleeve 52 is secured within the shaft 12 adjacent to its forward end 18. The sleeve 52 has an internal bead 46 provided about its internal diameter at the end opposite the forward end 18 of the shaft 12. The bead 46 is engaged by the rear end of the body portion 44 of the tip 30 and holds the tip 30 in a forwardly extended position displaced a distance 42 forward of the end of shaft 12. Upon the impact of the tip 30 with the animal, the restaining forces of the bead 46 are overcome by the inertia of the shaft 12 and the stem 28 and stop member 26 are longitudinally translated until the stop member's fingers 36 activate through the slots 24 of the shaft 12 to their open position. The bead 46 provides the function of preventing the tip 30 from depressing towards the shaft 12 and prematurely activating the stop member 26 due to the high inertial forces generated when the arrow 10 is launched by the bow.

FIG. 4 shows the stop member 26 in a first closed position in which the forward ends of the fingers 36 are biased against the inner cylindrical wall 14 of the shaft 12 forward of the slots 24. In FIG. 5, the fingers 36 are translated in a rearward direction by the displacement of the tip 30 when it strikes its target until the ends of fingers 36 are disengaged from the inner cylindrical wall 14 of the shaft 12, enter the slots 24 and are activated outwardly. Also shown in FIG. 5 is the manner in which the depressing of the tip 30 to a point where it contacts the leading end 18 of the shaft 12 causes the body 44 of the tip 30 to overcome the bead 46 and to translate the stem 28 in a longitudinal direction towards the rear or nock end of the shaft 12.

Referring again to FIGS. 4 and 5, and to FIG. 9, the slots 24 formed through the shaft 12 have first and second ends 70 and 72 adjacent the fingers 36 of the stop member 26. The second end 72 of the slot 24 is disposed at a 23° angle with respect to the horizontal axis of the shaft 12 and is engaged by the fingers 36 upon their activating outward. The angle at the end of slot 24 is provided to eliminate any sharp corners which may result in a bending or breaking of the fingers 36. The location of the rear end of the slot 24 determines the angle of the fingers 36. This enables the fingers 36 of the stop member 26 to activate to an optimal angle with respect to the animal's hide to optimize the gripping qualities of the stop member 26.

Referring again to FIGS. 4 and 5, and to FIG. 6, the arrowhead assembly 16 has a main body 50 with concentric internal and external sleeves 52 and 54. The sleeves 52 and 54 slidably engage the leading end 18 of the shaft 12 to secure the arrowhead 16 thereto. The inner and outer concentric sleeves 52 and 54 are joined along a front edge 56 adjacent the leading end 18 of the shaft 12 and the spaced tip 30. Blades 58 are attached to the external sleeve 54 by means of longitudinal slots 60 formed in the external sleeve 54. The blades 58 abut with a shoulder 62 at a rear end of the arrowhead 16 to prevent them from being dislodged from the longitudinal slots 60 upon impact with an animal. Referring to FIG. 9, an adhesive 61 may also be provided to secure the blades 58 within the slots 60.

Referring again to FIGS. 5 and 6, and to FIG. 6A, a circular ring 55 is mounted radially about the shaft 12 and pierces the blades 58 of the arrowhead 16. The circular ring 55 is composed of a stainless steel or like material so as to be strong yet flexible. Apertures 57 are formed in the blades 58 to receive the circular ring 55. The ring 55 is provided with a slit 59 permitting it to be mounted through the blade apertures 57 in a twist-on manner. The slit 59 is then sealed by welding or other means to permanently mount the ring 55 onto the arrowhead 16 assembly.

The circular ring 55 stabilizes the blades 58 upon impact with the animal's hide. Consequently, the likelihood of the blades 58 breaking off and becoming lost inside the animal are decreased. Also, upon penetration of the arrowhead 16 within the hide, the ring 55 causes the flaps in the animal's hide (not shown), cut by the blades 58, to increase in size. Therefore, the cutting effect of the arrowhead 16 may be increased by use of the circular ring 55.

FIG. 7 is a cross section of the fingers 36 of the stop member 26 of FIG. 5 in their activated position and extending through the slots 24 formed in the arrow shaft 12. FIG. 8 shows a partial cross section of the stop member 26 in FIG. 4. The fingers 36 are angularly displaced relative to the blades 15 so that the fingers 36 will not enter the holes made by the blades 15 when they contact the outer surface of the animal, as shown in FIG. 9. The fingers 36 of the stop member 26 are connected to the stem 28 (not shown in FIG. 8) by an intermediate portion 64. The intermediate portion 64 is provided with a channel 68 through which the common base 38 of the fingers 36 extends.

Figure 13:
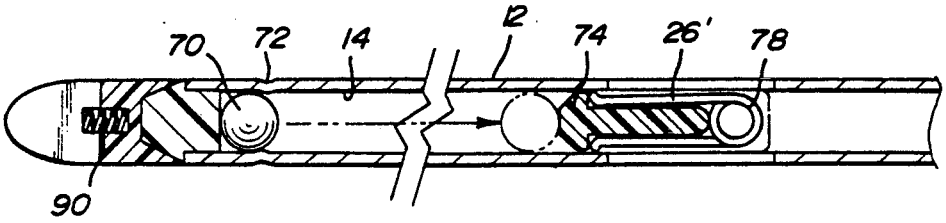
FIG. 13 is a view of the preferred embodiment of FIG. 12 and showing the means for actuating the stop member of the present invention as well as the spring loaded nock.

Referring to FIGS. 12 and 13, in a further preferred embodiment, a bead 70 is insertable into the hollow shaft 12 proximate to its trailing end 22. A dimple 72 is further provided at the trailing end 22 where it restrains the bead 70. When the arrow 10 impacts the wild game, the inertial forces created cause the bead 70 to break through the dimple 72 and to travel along the inside of the hollow shaft 12 toward its leading end 18.

Figure 14:
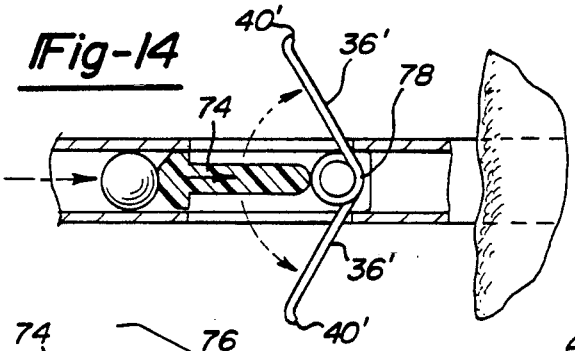
FIG. 14 is a view similar to that shown in FIG. 13 and showing the stop member actuating to their open position.
Figure 15:
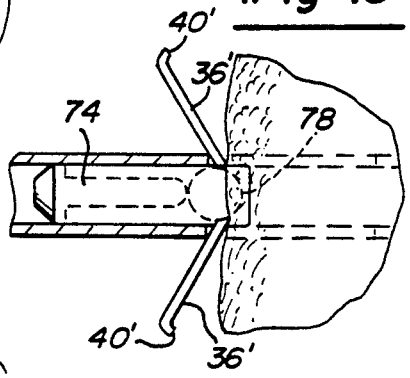
FIG. 15 is a view similar to that shown in FIG. 14 showing the engagement of the stop member with the target.
Figure 16:
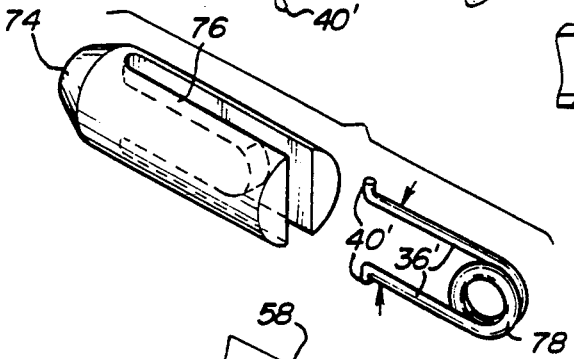
FIG. 16 is an exploded view of the displacing member and stop member of the embodiment of FIG. 13.

Referring again to FI(,S. 13, and to FIGS. 14 through 16, a displaceable member 74 is provided within the hollow shaft 12 and is impacted by the bead 70. The displaceable member 74 has a U-shaped channel 76 formed longitudinally therein which houses the stop member 26'. The base of the stop member 26' in this embodiment is a torsional spring 78. Upon striking of the bead 70 against the displaceable member 74, the displaceable member 74 is translated longitudinally until the ends 40' of the stop member 26' are disengaged from the inner cylindrical wall of the shaft 12 and are allowed to extend outwardly through the slots 24. In this embodiment, the fingers 36' extend from the shaft 12 in a direction opposite that shown in FIG. 4 yet provide the same gripping abilities as described in the previous embodiment due to the angling of the finger ends 40'.

Figure 17:
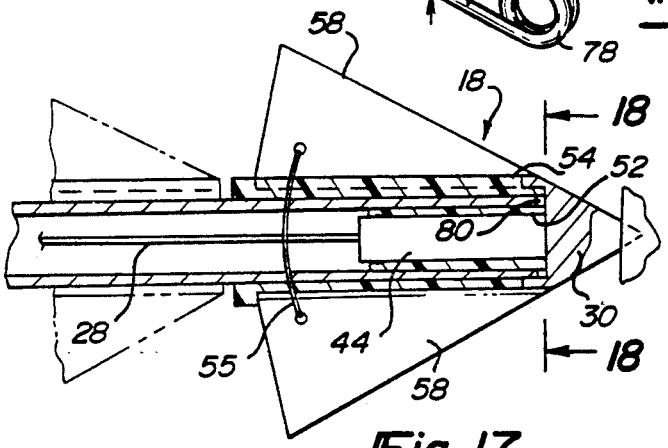
FIG. 17 is a sectional view of the detachable arrowhead feature of the present invention.
Figure 18:
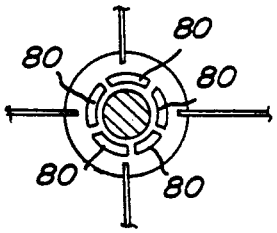
FIG. 18 is a cut-away view taken along line 18—18 of FIG. 17 and showing the frangible connections between the concentric layers of the arrowhead of the present invention.

Referring to FIGS. 17 and 18, the present invention further provides the arrowhead 16 assembly being slidably detachable from the leading end 18 of the shaft 12 and capable of translating along the shaft 12 to the point where it engages the stop member 26 when activated to its open position. The arrowhead 16 of this embodiment includes the concentric cylindrical sleeves 52 and 54 being positioned over the leading end 18 of the shaft 12, as described in the previous embodiments. A plurality of spaced frangible fingers 80 are provided to connect the inner and outer sleeves 52 and 54, as shown in FIG.

18. Upon impact, the arrow tip 30 depresses inwardly and fractures the frangible fingers 80 which hold together the inner 52 and outer 54 concentric sleeves. Once freed, the outer sleeve 54, with the attached blades 58, then translates longitudinally across the external surface of the shaft 12 until coming into an abutting contact with the actuated stop member 26. The arrowhead 16 then pierces the animal's hide up to a predetermined limited distance at which the stop member 26 engages the hide of the animal and prevents further travel of the arrowhead 16. The circular ring 55 further enhances the feature of the arrowhead 16 by providing the arrowhead 16 with additional support upon impact.

Referring again to FIGS. 10 and 11, a thin membrane 86 is applied over the slots 24 of the hollow shaft 12. Upon activating from the closed to the open position, the fingers 36 of the stop member 26 rupture the membrane 86. The purpose of the membrane 86 is to prevent any undesirable air-frictional effects which may act upon the arrow 10 during its flight.

Referring again to FIGS. 10 and 11, a further embodiment of the present invention is shown and provides the fingers 36 of the stop member 26 biased in their closed position by a catch mechanism 88 connected to the trailing end 34 of the stem 28. The stop member 26 in this embodiment is fixedly positioned in alignment with respect to the slots 24 due to portion 64' which secures to inner wall 14 of shaft 12. The location of the stop member 26 is therefore fixed with respect to the shaft 12 and only the catch mechanism 88 is displaced by the stem 28 thus permitting the fingers 36 to activate to their open position when the tip 30 contacts a target.

In a final embodiment, referring to FIGS. 1 and 13, a coil spring 90 is provided in the arrow nock 20. The coil spring 90 assists in the disengagement of the nock 20 from the bowstring when the arrow 10 is launched. The spring 90 compensates for frictional losses to the draw force imparted on the arrow by the bow due to the disengagement of the bowstring from the arrow's nock 20. The spring 90 is disposed between projecting members 92 of the nock 20 and extends rearwardly in a longitudinal direction. The projecting members 92 secure the bowstring to the nock in conventional fashion. The bowstring then causes the spring 90 to compress under the force of the draw of the bowstring against the arrow 10. The spring 90 then rapidly expands against the bowstring as the bowstring is released. The expanding of the spring 90 against the bowstring provides additional force which assists in the disengagement of the bowstring from the projecting members 92 of the nock 20 and results in the arrow 10 retaining that approximate amount of energy or force which would otherwise be lost due to the frictional disengagement of the bowstring from the projecting members 92 of the nock 20.

Having described my invention, many embodiments thereof will become apparent to those skilled in the art to which it pertains.

I claim:

1. An arrow construction for use with a bow in hunting wild game, comprising:

a shaft having a hollow interior;

an arrowhead attached to a leading end of said shaft;

a stop member disposed in said shaft for limiting the travel of said shaft and said arrowhead into the body of said wild game in response to said arrowhead impacting said wild game, said stop member expanding radially from said shaft in response to said arrowhead impacting said wild game; and means responsive to said arrowhead impacting said wild game for activating said stop member from a closed position within said hollow interior of said shaft to an open position outside said shaft, said stop member opening in a direction facing said arrowhead, said means for activating said stop member includes:

a stem longitudinally disposed within said hollow interior of said shaft, said stem having a first end attached to said stop member; and a tip of said arrow spaced a predetermined distance away from said leading end of said shaft, said tip being attached to a second end of said stem opposite said first end; and wherein said tip of said arrow is displaceable said predetermined distance upon impacting said wild game, said displacement of said tip displacing said stem and said stop member, said displacement of said stop member permitting said stop member to activate from said closed to said open position.

2. The invention as described in claim 1, wherein said stop member includes at least one extending finger, said at least one extending finger having a free end angled to engage said hide of the game in said open position, said at least one extending finger further being resiliently biased towards said open position.

3. The invention as described in claim 1, wherein said shaft has at least one slot, said at least one stop member being aligned with said at least one slot when said tip is displaced said predetermined distance, said at least one slot permitting at least one finger of said stop member to extend outwardly from said shaft.

4. The invention as described in claim 3, wherein said slot has a first end and a second end, said first end being positioned closer to said arrowhead then said second end, said second end having an edge angled at 23° with respect to the longitudinal axis of said shaft between said first and second ends.

5. The invention as described in claim 4, wherein said arrowhead has concentric inner and outer sleeves and blades which are attached to said outer sleeve, said inner and outer sleeves engaging respectively an inner and outer surface of said shaft.

6. An arrow construction for use with a bow in hunting wild game, comprising:

a shaft having a hollow interior;

an arrowhead attached to a leading end of said shaft;

a stop member disposed in said shaft for limiting the travel of said shaft and said arrowhead into the body of said wild game in response to said arrowhead impacting said wild game, said stop member expanding radially from said shaft in response to said arrowhead impacting said wild game; and means responsive to said arrowhead impacting said wild game for activating said stop member from a closed position within said hollow interior of said shaft to an open position outside said shaft, said stop member opening in a direction facing said arrowhead, said means for activating said stop member includes:

a bead insertable into said hollow shaft;

means for restraining the displacement of said bead in response to forces below a predetermined value; and wherein, when inertial forces caused by the impact of said arrow with said wild game exceeds said predetermined value, said inertial forces cause said bead to travel through said hollow shaft toward and impact said stop member, said bead activating said stop member to said open position upon impact with said stop member.

7. The invention as described in claim 6, further including a displaceable member positioned within said shaft, said displaceable member having a U-shaped channel formed longitudinally therein, said stop member being housed within said U-shaped channel, said displaceable member upon being struck by said bead translates longitudinally within said shaft to align said stop member with at least one slot formed in said shaft.

8. An arrow construction for use with a bow in hunting wild game, comprising:

a shaft having a hollow interior;

an arrowhead attached to a leading end of said shaft;

a stop member disposed in said shaft for limiting the travel of said shaft and said arrowhead into the body of said wild game in response to said arrowhead impacting said wild game, said stop member expanding radially from said shaft in response to said arrowhead impacting said wild game;

means responsive to said arrowhead impacting said wild game for activating said stop member from a closed position within said hollow interior of said shaft to an open position outside said shaft, said stop member opening in a direction facing said arrowhead; and means for detaching said arrowhead from said leading end of said arrow shaft in response to said arrow impacting said wild game, said arrowhead translating along said arrow shaft to engage said stop member in said open position as said arrow penetrates said wild game.

9. An arrow construction for use with a bow in hunting wild game, comprising:

a shaft having a hollow interior;

an arrowhead attached to a leading end of said shaft;

means disposed in said shaft for limiting the travel of said shaft and said arrowhead into the body of said wild game in response to said arrowhead impacting said wild game; and a circular ring mounted to said arrowhead and around said shaft.

10. An arrow construction for use with a bow in hunting wild game, comprising:

a shaft having a hollow interior;

an arrowhead attached to a leading end of said shaft;

means disposed in said shaft for limiting the travel of said shaft and said arrowhead into the body of said wild game in response to said arrowhead impacting said wild game; and means for overcoming frictional losses to said arrow due to the disengagement of a bowstring of the bow from said neck.

11. The invention as described in claim 10, wherein said means for overcoming frictional losses due to the disengagement of the bowstring from said nock is a coil spring disposed between projecting members of said nock, said spring compressing under the force of the bowstring when the bow is in a drawn position, said coil spring expanding against the bowstring as the bowstring is released to compensate for the frictional losses inherited by said arrow upon said disengagement.

* * * * *